US009917373B1

(12) United States Patent
Channabasappa et al.

(10) Patent No.: US 9,917,373 B1
(45) Date of Patent: Mar. 13, 2018

(54) LOW-COST BEAM-FORMING ANTENNA SYSTEM FOR ACHIEVING HIGH GAIN

(71) Applicant: Amazon Technologies, Inc., Reno, NV (US)

(72) Inventors: Eswarappa Channabasappa, Sunnyvale, CA (US); Adrian Napoles, Cupertino, CA (US)

(73) Assignee: Amazon Technologies, Inc., Seattle, WA (US)

( * ) Notice: Subject to any disclaimer, the term of this patent is extended or adjusted under 35 U.S.C. 154(b) by 352 days.

(21) Appl. No.: 14/817,096

(22) Filed: Aug. 3, 2015

(51) Int. Cl.
*H01Q 1/24* (2006.01)
*H01Q 21/00* (2006.01)

(52) U.S. Cl.
CPC ..... *H01Q 21/0056* (2013.01); *H01Q 1/24* (2013.01); *H01Q 21/005* (2013.01)

(58) Field of Classification Search
CPC ..... H01Q 21/005; H01Q 1/24; H01Q 21/0056
USPC ..... 343/702
See application file for complete search history.

(56) References Cited

U.S. PATENT DOCUMENTS 3,032,762 A * 5/1962 Kerr ..... H01Q 13/04 343/771

* cited by examiner

*Primary Examiner* — Graham Smith
(74) *Attorney, Agent, or Firm* — Lowenstein Sandler LLP

(57) ABSTRACT

Antenna structures and methods of operating the same are described. One apparatus includes a metal housing that includes a first slot formed in a first portion of a wall of the metal housing and a second slot formed in a second portion of the wall. The apparatus includes a fin structure disposed within the metal housing. The fin structure includes fins that form a first sectorial cavity behind the first portion of the wall corresponding to the first slot and a second sectorial cavity behind the second portion of the wall corresponding to the second slot. Radio frequency (RF) circuitry is disposed on a circuit board disposed within the metal housing and is operable to radiate electromagnetic energy via the first slot and to radiate electromagnetic energy via the second slot.

20 Claims, 7 Drawing Sheets

LOW-COST BEAM-FORMING ANTENNA SYSTEM FOR ACHIEVING HIGH GAIN

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas. Achieving

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
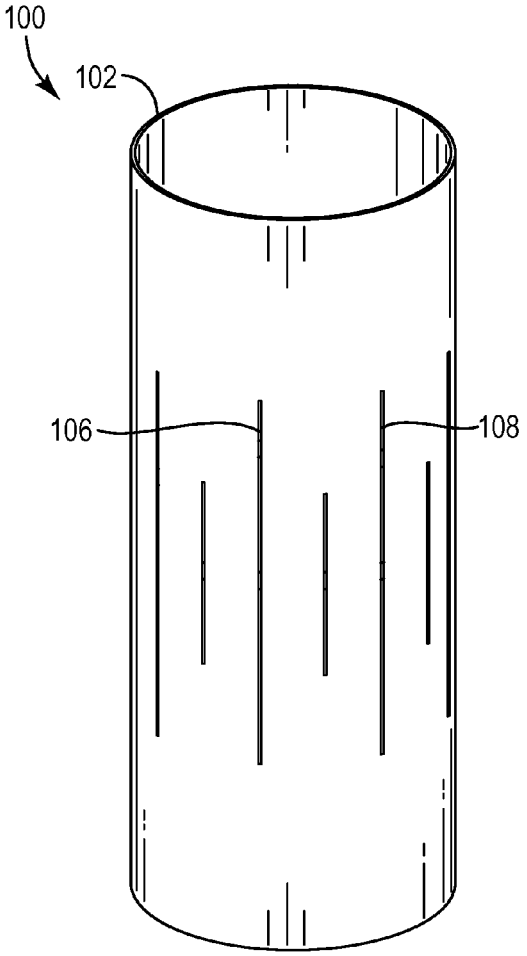
FIG. 1A illustrates a cylindrical metal housing and a set of radial fins of a device according to one embodiment.

Antenna structures and methods of operating the same are described. One apparatus includes a metal housing that includes a first slot formed in a first portion of a wall of the metal housing and a second slot formed in a second portion of the wall. The apparatus includes a fin structure disposed within the metal housing. The fin structure includes fins that form a first sectorial cavity behind the first portion of the wall corresponding to the first slot and a second sectorial cavity behind the second portion of the wall corresponding to the second slot. Radio frequency (RF) circuitry is disposed on a circuit board disposed within the metal housing and is operable to radiate electromagnetic energy via the first slot and to radiate electromagnetic energy via the second slot.

The embodiments described herein are directed to slot antennas that can use the metal cover of the housing and fin structures that form sectorial cavities to increase isolation between the slot antennas.

Stronger receive power is needed to achieve high data rate with wireless local area network (WLAN) antennas, e.g., antennas using the Wi-Fi® technology using IEEE 802.11ac standard. For example, to achieve a data rate of 400 Mbit/s using 80 MHz bandwidth, received powers of the order of −60 dBm are needed. Also, path loss and path attenuation are very high for 5 GHz WLAN frequency band. There is a plenty of frequency bandwidth available in 5 GHz WLAN band. Hence, high gain antenna beams that can be scanned or switched in the space are used.

For multi-user multiple-input multiple-output (MU-MIMO) antenna system, two to eight antennas may be used to achieve data rates up to several Gbits/s. However, antennas using different technologies may need separate antennas. For example, the system may include one antenna using the Bluetooth® technology for 2.45 GHz BT-LE and another antenna using the Zigbee® technology for 2.45 GHz. Traditionally, these antennas need to be separated in space or time-division multiplexed during operation.

Traditional phased array antennas for electronic beam-scanning are very expensive and complex. Hence, they can't provide a simple low-cost solution. For example, when building antenna arrays for obtaining high gains, the following problems can be encountered: 1) How to pack all the antenna elements in a small volume to minimize product size; 2) How to feed all the antenna elements in a cost effective and easy to manufacture manner; and/or 3) How to isolate the antenna elements such that they do not significantly couple to each other.

The embodiments described herein are directed to a simple system for densely packing multiple antennas into a small volume at low cost. For example, in one embodiment, the system includes 16 antennas, including 8 antennas using the Wi-Fi® technology for 2.45 GHz and 8 antennas using the Wi-Fi® technology for 5 GHz). In one embodiment, the system includes the following attributes: (1) multiple slots of various lengths on a metal housing (e.g., a metal cylindrical housing); (2) a fin structure (e.g., a radial fin system) for isolating the various antennas; and (3) a unique and low-cost method to feed all the antennas.

The embodiments described herein may improve industrial design by enabling the use of metal on outer surfaces of the housing of the electronic device.

The antenna structures described herein can be used for wireless local area network (WLAN) technologies (e.g., Wi-Fi® technologies), personal area network (PAN) technologies (e.g., Bluetooth® and Zigbee® technologies), wireless area network (WAN) technologies, such as cellular technologies including Long Term Evolution (LTE) frequency bands, third generation (3G) frequency bands, global navigation satellite system (GNSS) frequency bands (e.g., positioning system (GPS) frequency bands, or the like.

FIG. 1A illustrates a cylindrical metal housing 102 and a set of radial fins 104 of a device 100 according to one embodiment. The set of radial fins 104 fits within the cylindrical metal housing 102 of the device 100 according to one embodiment. The device 100 may be an audio-input-enabled device, such as the Amazon Echo device, developed by Amazon Technologies, Inc. of Seattle Wash. The cylindrical metal housing 102 may be formed of metal materials or may be formed of plastic and coated in metal. The cylindrical metal housing 102 is a cylinder with a wall having an outer surface and an inner surface. A first slot 106 is formed in the wall of the cylindrical metal housing 102 and oriented along a length of the cylindrical metal housing 102 in a first axis. A second slot 108 is formed in the wall of the cylindrical metal housing 102 and oriented along the length of the cylindrical metal housing 102 in a second axis.

A printed circuit board (PCB) 110 is disposed within cylindrical metal housing 102. A processor and RF circuitry (not illustrated in FIGS. 1A-1B) are disposed on the PCB 110. The PCB 110 includes a first conductive trace coupled between the RF circuitry and a first feeding point on an inner surface of the cylindrical metal housing 102 near the first slot 106 and a second conductive trace coupled between the RF circuitry and a second feeding point on the inner surface of the cylindrical metal housing 102 near the second slot 108. The set of radial fins 104 is disposed within the cylindrical metal housing 102. The set of radial fins 104 and the inner surface of the cylindrical metal housing 102 form sectorial cavities. A first sectorial cavity 112 is located behind a first portion of the wall corresponding to the first slot 106 and a second sectorial cavity 114 is located behind a second portion of the wall corresponding to the second slot 108. More specifically, two adjacent radial fins and the inner surface of the first portion of the wall form the first sectorial cavity 112 and another two adjacent radial fins and the inner surface of the second portion of the wall form the second sectorial cavity 114.

In one embodiment, the first slot 106 is disposed on a first centerline of the first portion corresponding to the first sectorial cavity 112 and the second slot 108 is disposed on a second centerline of the second portion corresponding to the second sectorial cavity 114. Alternatively, the first slot 106, the second slot 108, or both are disposed on an axis that is offset from the respective centerline of the respective sectorial cavity.

In a further embodiment, the cylindrical metal housing 102 includes a third slot formed in the same first portion of the wall as the first slot 106 and is orientated along the length of the cylindrical metal housing 102 in a third axis that is parallel to the first axis. The first sectorial cavity 112 is located behind the first portion of the wall corresponding to the first slot 106 and the third slot. In a further embodiment, a fourth slot is formed in the second portion of the wall of the cylindrical metal housing and oriented along the length of the cylindrical metal housing in a fourth axis that is parallel to the second axis. The second sectorial cavity is located behind the second portion of the wall corresponding to the second slot and the fourth slot. The first slot has a first length, the second slot has the first length, the third slot has a second length and the fourth slot has the second length. The second length is less than the first length. In one embodiment, the first length corresponds to a first frequency range, such as 2.45 GHz, and the second length corresponds to a second frequency range, such as 5 GHz. In another embodiment, the third slot and fourth slot are formed in different portions corresponding to different sectorial cavities than the first or portions, such as four individual slots in individual ones of the four sectorial cavities.

In another embodiment, the cylindrical metal housing includes a fifth slot formed in the wall and oriented along a circumference of the cylindrical metal housing in a first plane perpendicular to the first axis. In a further embodiment, the cylindrical metal housing includes a sixth slot formed in the wall and oriented along the circumference of the cylindrical metal housing in a second plane perpendicular to the first axis. The sixth slot may be shorter in length than the fifth slot.

Figure 1B:
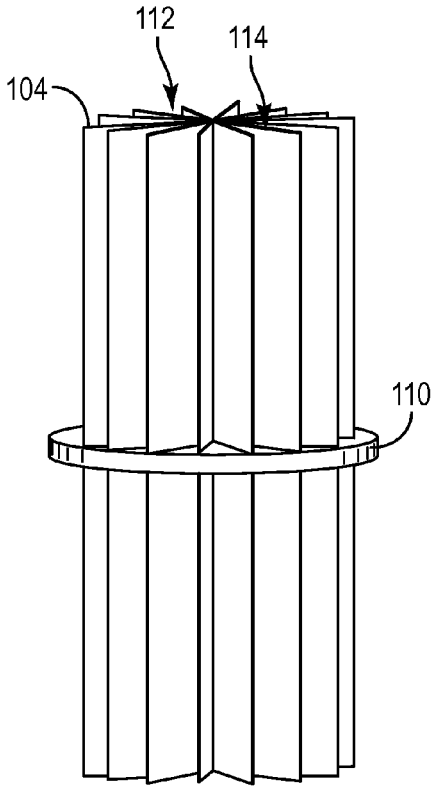
FIG. 1B illustrates a set of radial fins that fits within the cylindrical metal housing of the device of FIG. 1A according to one embodiment.

In the depicted embodiment of FIG. 1B, the set of radial fins 104 include a first subset of radial fins disposed on a first side of the PCB 110 and a second subset of radial fins disposed on a second side of the PCB 110. The PCB 110 is disposed perpendicular to the first slot 106 and the second slot 108 at a middle of the first slot and a middle of the second slot. Alternatively, the PCB 110 can be disposed at a bottom of the first slot 106 and the second slot 108, or at the bottom of the lowest slot formed in the wall of the cylindrical metal housing 102. Alternatively, the PCB 110 can be disposed at a top of the first slot 106 and the second slot 108, or at a top of the highest slot formed in the wall of the cylindrical metal housing 102 of the cylindrical metal housing 102.

As illustrated in FIG. 1B, the set of radial fins 104 includes sixteen fins that form sixteen sectorial cavities that can accommodate at least sixteen separate slot antennas. Also, when multiple slots of different lengths are disposed in one sectorial cavity, the number of slot antennas can be greater than sixteen. The set of radial fins 104 may include as little as one fin that separates the cylindrical metal housing 102 in half, forming two sectorial cavities.

The cylindrical metal housing 102 and set of radial fins 104 can be used in an antenna beam-forming system that is very simple to manufacture. The antenna beam-forming system can provide high gain beams in the desired directions. The slots in the cylindrical metal housing 102 can be resonant slots of varying lengths depending upon the frequency of operation. In the depicted embodiment, these slots are backed by triangular shaped cavities (e.g., first sectorial cavity 112 and second sectorial cavity 114). The triangular shaped cavities may result in better isolation, bandwidth and higher-order mode control of the antenna beam-forming system.

In some cases, there are basically 3 parts: radial fins, a PCB for feeding the slots and an outer metallic cover with slot openings. All the slots can be fed from a single PCB, thus simplifying the feeding of multiple slots, such as 16 slots or more. The radial fins can be made of plastic and then plated with copper or may be made of metal material. These slot antennas are about 90% efficient and can be switched on in the desired direction or could be all operated at the same time for multi-user Multi-Input Multi-Output (MU-MIMO) operation.

Figure 1C:
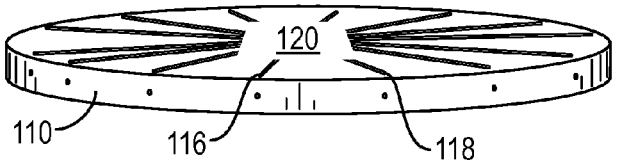
FIG. 1C illustrates the printed circuit board within the cylindrical metal housing of the device of FIG. 1A according to one embodiment.

FIG. 1C illustrates the PCB 110 within the cylindrical metal housing 102 of the device 100 of FIG. 1A according to one embodiment. The PCB 110 includes RF circuitry 120 disposed on the PCB 110. The RF circuitry 120 may include one or more RF circuits, RF modules, or the like. The PCB 110 may also include a processor (not illustrated in FIG. 1C). The PCB 110 also includes conductive traces from the RF circuitry 120 to feeding points near the slots formed in the cylindrical metal housing 102. For example, a first conductive trace 116 is coupled between the RF circuitry 120 and a first feeding point near the first slot 106 and a second conductive trace 118 is coupled between the RF circuitry 120 and a second feeding point near the second slot 108.

Figure 2:
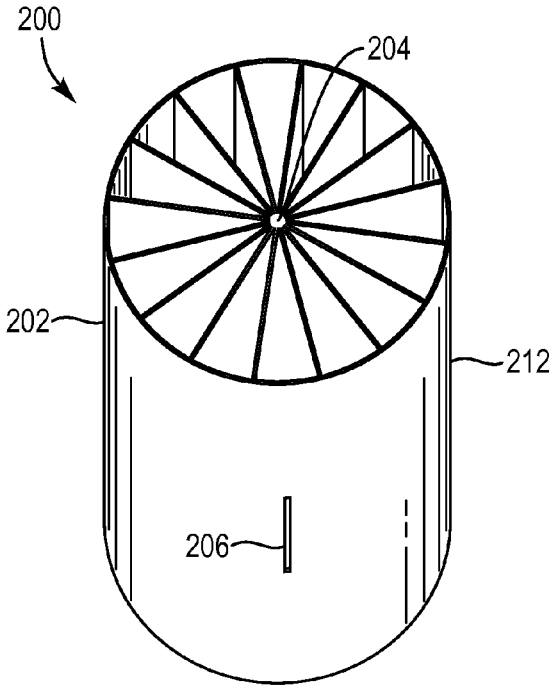
FIG. 2 illustrates a cylindrical metal housing and a set of radial fins of a device according to another embodiment.

FIG. 2 illustrates a cylindrical metal housing 202 and a set of radial fins 204 of a device 200 according to another embodiment. The perspective view of the device 200 shows the set of radial fins 204 disposed within the cylindrical metal housing 202. It should be noted that the cylindrical metal housing 202 is illustrated without a top end to show the set of radial fins 204. The cylindrical metal housing 202 may be formed of metal materials or may be formed of plastic and coated in metal. The cylindrical metal housing 202 is a cylinder with a wall having an outer surface and an inner surface. A first slot 206 is formed in the wall of the cylindrical metal housing 202 and oriented along a length of the cylindrical metal housing 202 in a first axis. In this embodiment, the first slot 206 is disposed on a centerline of a first sectorial cavity 212 formed by the set of radial fins 204. It should be noted that only one slot is shown for ease of description and illustration, and, in other embodiments, more than one slots can be formed in the wall of the cylindrical metal housing 202. For example, a slot can be formed in each of the sectorial cavities formed by the set of radial fins 204.

Figure 3A:
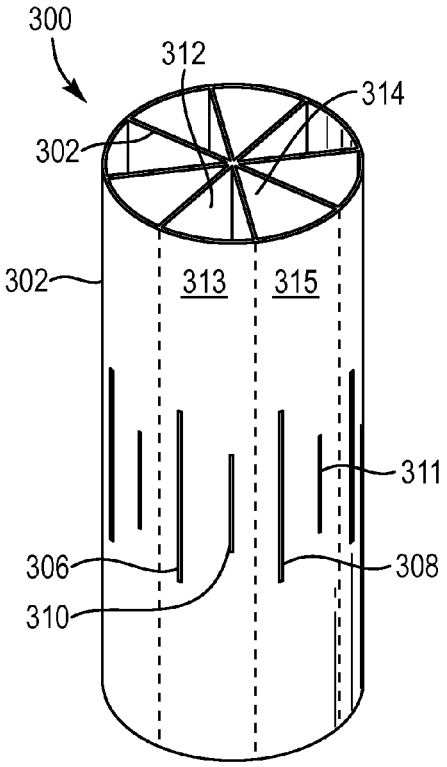
FIG. 3A illustrates a cylindrical metal housing and a set of radial fins of a device according to another embodiment.
Figure 3B:
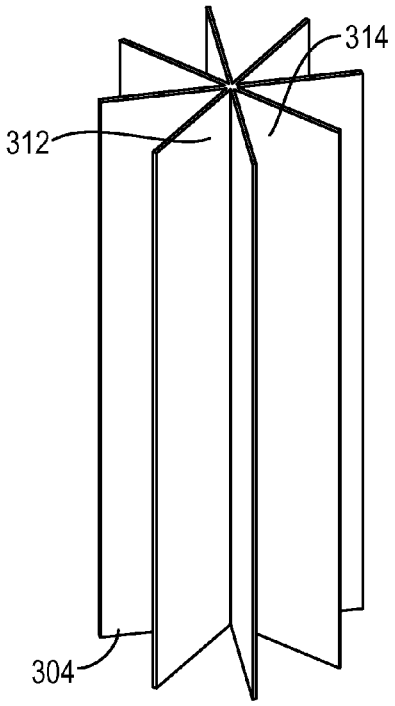
FIG. 3B illustrates the set of radial fins that fits within the cylindrical metal housing of the device of FIG. 3A according to one embodiment.

FIG. 3A illustrates a cylindrical metal housing 302 and a set of radial fins 304 of a device 300 according to another embodiment. FIG. 3B illustrates the set of radial fins 304 that fits within the cylindrical metal housing 302 of the device 300 of FIG. 3A according to one embodiment. The cylindrical metal housing 302 includes multiple slots formed in the wall, including at least a first slot 306 formed in a first portion of the wall, a second slot 308 formed in a second portion of the wall, a third slot 310 formed in the first portion of the wall, and a fourth slot 311 formed in the second portion of the wall. The first slot 306 and the third slot 310 are formed in the first portion that corresponds to the first sectorial cavity 312. The second slot 308 and the fourth slot 311 are formed in the second portion that corresponds to the second sectorial cavity 314. The dashed lines are added to FIG. 3A to identify the first portion 313 of the wall corresponding to the first sectorial cavity 312 and the second portion 315 of the wall corresponding to the second sectorial cavity 314.

As illustrated in FIG. 3A, in one embodiment, the first slot 306 has a first length, the second slot 308 has the first length, the third slot 310 has a second length and the fourth slot 311 has the second length. The second length is less than the first length. Alternatively, the different slots can have different lengths depending on the desired operating frequency for the respective slot.

Figure 4A:
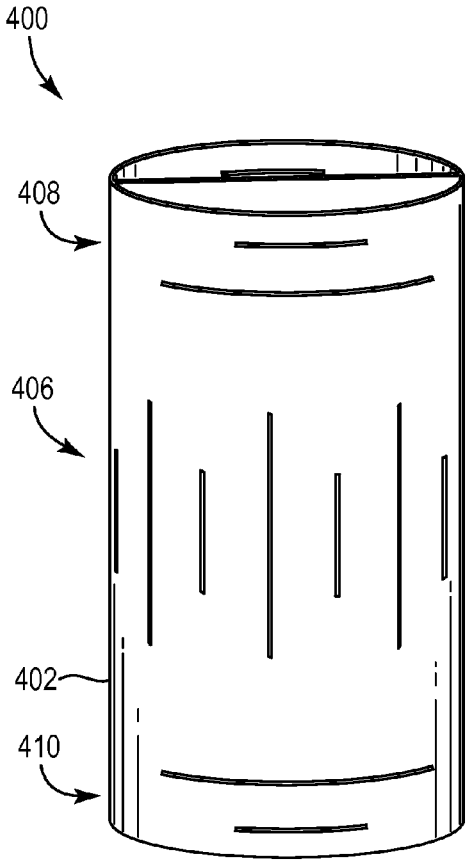
FIG. 4A illustrates a cylindrical metal housing and a fin structure of a device according to another embodiment.
Figure 4B:
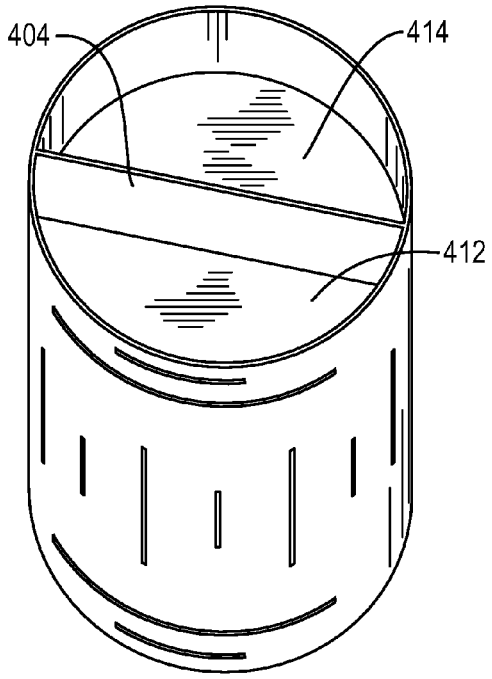
FIG. 4B illustrates a top fin of the fin structure of the device of FIG. 4A according to one embodiment.

FIG. 4A illustrates a cylindrical metal housing 402 and a fin structure of a device 400 according to another embodiment. FIG. 4B illustrates a top fin of the fin structure of the device 400 of FIG. 4A according to one embodiment. The cylindrical metal housing 402 includes a set of vertical slots 406, a first set of horizontal slots 408, and a second set of horizontal slots 410. The set of vertical slots 406 can include multiple length slots. The first set of horizontal slots 408 and the second set of horizontal slots 410 can include multiple length slots. The fin structure includes a top fin 404 that forms a first sectorial cavity 412 and a second sectorial cavity 414. The first sectorial cavity 412 is formed behind two slots of the first set of horizontal slots 408 and the second sectorial cavity 414 is formed behind another two slots of the first set of horizontal slots 408. The fin structure also includes a bottom fin, similar to the top fin 404, the bottom fin forming a third sectorial cavity and a fourth sectorial cavity formed behind the second set of horizontal slots 410. The fin structure also includes a set of radial fins similar to the radial fins described in FIGS. 1-3B. The top fin 404 is separated from the set of radial fins by a top cap and the bottom fin is separate from the set of radial fins by a bottom cap.

In one embodiment, a first slot of the set of vertical slots 406 is oriented along a length of the cylindrical metal housing 402 in a first axis and a second slot of the vertical slots 406 is oriented along the length of the cylindrical metal housing 402 in a second axis parallel to the first axis. A third slot of the horizontal slots 408 is oriented along a circumference of the cylindrical metal housing 402 in a first plane perpendicular to the first axis. In a further embodiment, a fourth slot of the set of horizontal slots 408 is oriented along the circumference of the cylindrical metal housing 402 in a second plane perpendicular to the first axis. The third slot may be longer in length than the fourth slot.

The first set of horizontal slots 408 and the second set of horizontal slots 410 with the half-cylindrical cavities can be used as WLAN antennas with vertical polarization, such as one slot antenna for the 5 GHz frequency band and another slot antenna for the 2.45 GHz frequency band. The set of vertical slots 406 with triangular-shaped cavities can be used as WLAN antennas with horizontal polarization, such as one slot antenna for the 5 GHz frequency band and another slot antenna for the 2.45 GHz frequency band. It should be noted that a longer length of slot may be used to achieve lower frequency ranges, such as 900 MHz.

As depicted in FIGS. 4A-4B, the cylindrical metal housing 402 and the fin structure can be used in an antenna beam-forming system with both vertical and horizontal slots. The horizontal slots may be backed by half-cylindrical cavities in the top of the cylindrical metal housing 402 and bottom of the cylindrical metal housing 402. In one embodiment, there are a total of 24 slots in the cylindrical metal housing, permitting implementation of at least 24 different antennas. The horizontal slots can be used to form a first radiation pattern and the vertical slots can be used to form a second radiation pattern. Both polarization and spatial diversity can be obtained effortlessly using the embodiments described herein. Polarization and spatial diversity of these embodiments can be used for implementing MU-MIMO systems.

Figure 5A:
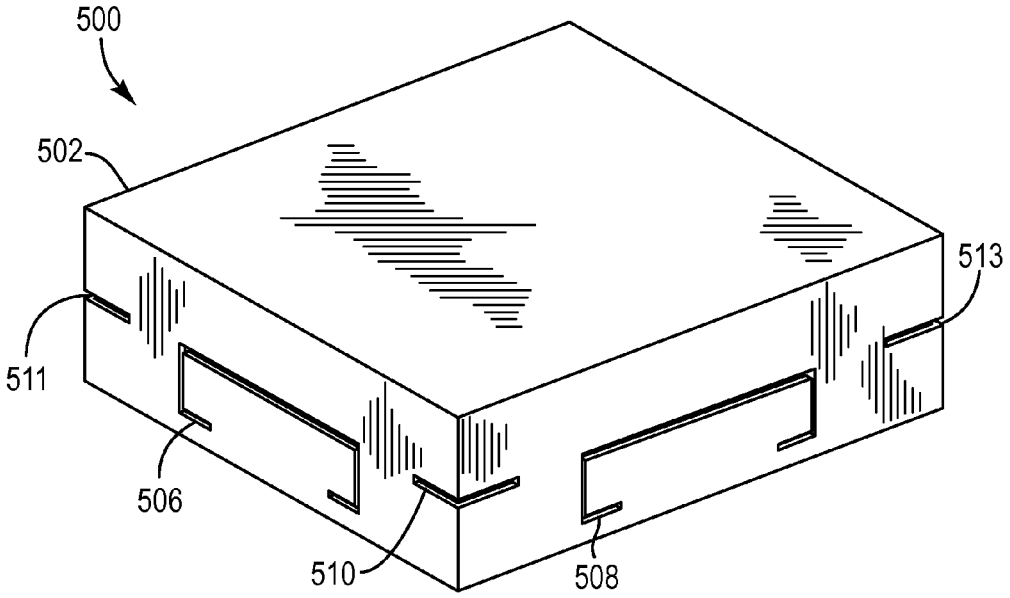
FIG. 5A illustrates a metal housing of an electronic device according to one embodiment.
Figure 5B:
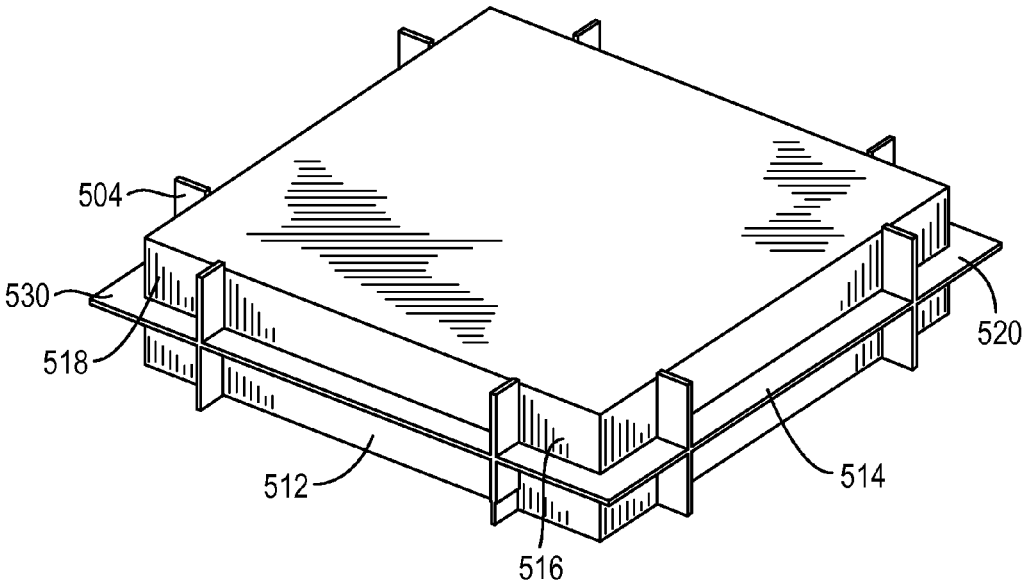
FIG. 5B illustrates a fin structure that fits within the metal housing of the electronic device of FIG. 5A according to one embodiment.

FIG. 5A illustrates a metal housing 502 of an electronic device 500 according to one embodiment. FIG. 5B illustrates a fin structure 504 that fits within the metal housing 502 of the electronic device 500 of FIG. 5A according to one embodiment. The metal housing 502 is a first polyhedron, specifically a first cuboid (sometimes referred to as a box). The metal housing 502 includes multiple slots formed in the wall, including at least a first slot 506 formed in a first portion of the wall, a second slot 508 formed in a second portion of the wall, a third slot 510 formed in a third portion of the wall, a fourth slot 511 formed in a fourth portion of the wall, and a fifth slot 513 formed in a fifth portion of the wall. The first slot 506 is formed in the first portion that corresponds to a first sectorial cavity 512. The second slot 508 is formed in the second portion that corresponds to a second sectorial cavity 514. The third slot 510 is formed in the third portion that corresponds to a third sectorial cavity 516. The fourth slot 511 is formed in the fourth portion that corresponds to a fourth sectorial cavity 518. The fifth slot 513 is formed in the fifth portion that corresponds to a fifth sectorial cavity 520. Additional slots can be formed in the metal housing 502 and the fin structure 504 can include additional cavities for these additional slots.

As illustrated in FIG. 5A, in one embodiment, the first slot 506 has a first length, the second slot 508 has the first length, the third slot 510 has a second length and the fourth slot 511 has the second length. The second length is less than the first length. Alternatively, the different slots can have different lengths depending on the desired operating frequency for the respective slot. The first slot 506 and the second slot 508 can operate at a first frequency range and the third slot 510 and the fourth slot 511 can operate at a second frequency than is higher than the first frequency range. The multiple slots of various lengths on the faces of the metal housing 502. For example, the third slot 510 can be configured as an antenna that uses the Wi-Fi® technology for the 5 GHz frequency band with a vertical polarization (rectangular cavity behind the third slot 510). The first slot 506 can be configured as an antenna that uses the Wi-Fi® technology for the 2.45 GHz frequency band with a vertical polarization (rectangular cavity behind the first slot 506). In some embodiments, the upper and lower shield boxes can be used for shielding RF components, such as LNA, PAs, switches, or the like and for providing rectangular cavities behind the slots.

In the depicted embodiment of FIG. 5B, the fin structure 504 includes a set of fins disposed in a first orientation and a PCB 530 is disposed in a second orientation that is orthogonal to the first orientation. In other embodiments, the fin structures can be other shapes, such as a three-dimensional lattice structure.

In FIG. 5B, the fin structure 504 can also operate as a shielding structure for isolating the various antenna slots from one another and from circuits, such as LNA, PA, switches, or the like. The PCB 530 also provides a low-cost method to feed all the slots antennas. As described above, the metal housing 502 and fin structure 504 can be used to improve industrial design by enabling the use of the metal on the outer surfaces of the product.

Figure 6:
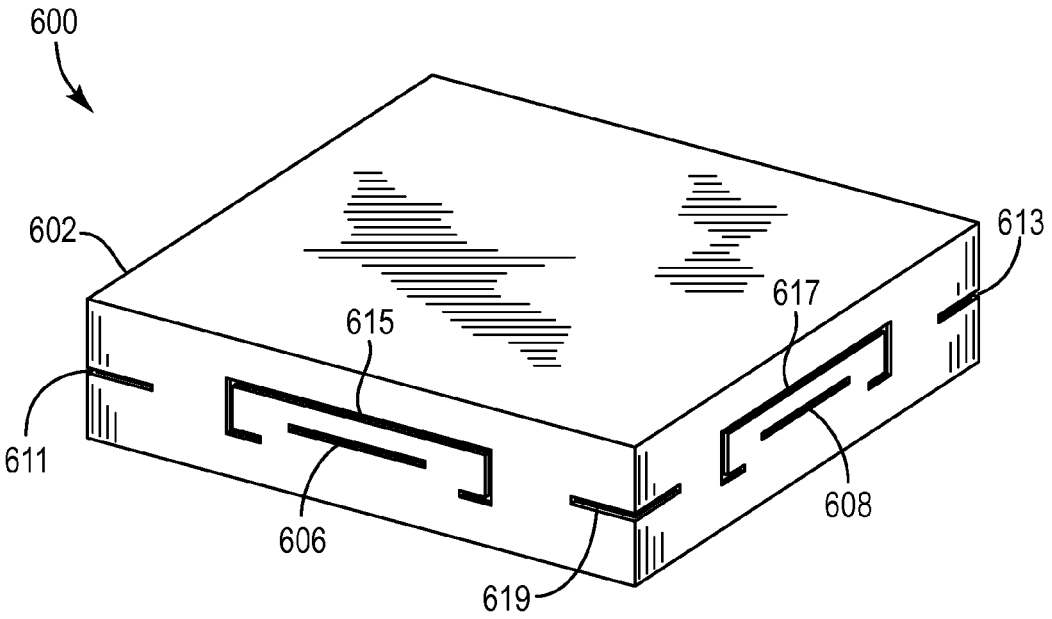
FIG. 6 illustrates a metal housing of an electronic device according to another embodiment.

FIG. 6 illustrates a metal housing 602 of an electronic device 600 according to another embodiment. The metal housing 602 includes a first slot 606 formed in a first side of the metal housing 602, a second slot 608 formed in a second side of the metal housing 602, a third slot 610 formed at a first corner between the first and second sides of the metal housing 602, a fourth slot 611 formed at a second corner between the first side and a third side of the metal housing 602, a fifth slot 613 formed at a third corner between the second side and a fourth side of the metal housing 602. The metal housing 602 also includes a sixth slot 615 formed in the first side of the metal housing 602 and a seventh slot 617 formed in the second side of the metal housing 602. The sixth slot 615 wraps around the first slot 606 and the seventh slot 617 wraps around the second slot 608. The slots formed in the metal housing 602 can be formed in other configurations in other embodiments.

In one embodiment, the electronic device 600 includes eight slots that operate at 5 GHz and four slots that operate at 2.45 GHz. A first switch can be disposed between four two-element 5 GHz antenna arrays and a second switch can be disposed between four single-element 2.45 GHz antenna arrays.

In another embodiment, the electronic device includes four slots that operate at 2.45 GHz for implementing the Wi-Fi® technology, two slots that operate at 2.45 GHz for implementing the Bluetooth® technology and two slots that operate at 2.45 GHz for implementing the Zigbee® technology within the electronic device. Alternatively, other combination of slots can be used to implement various technologies.

Figure 7:
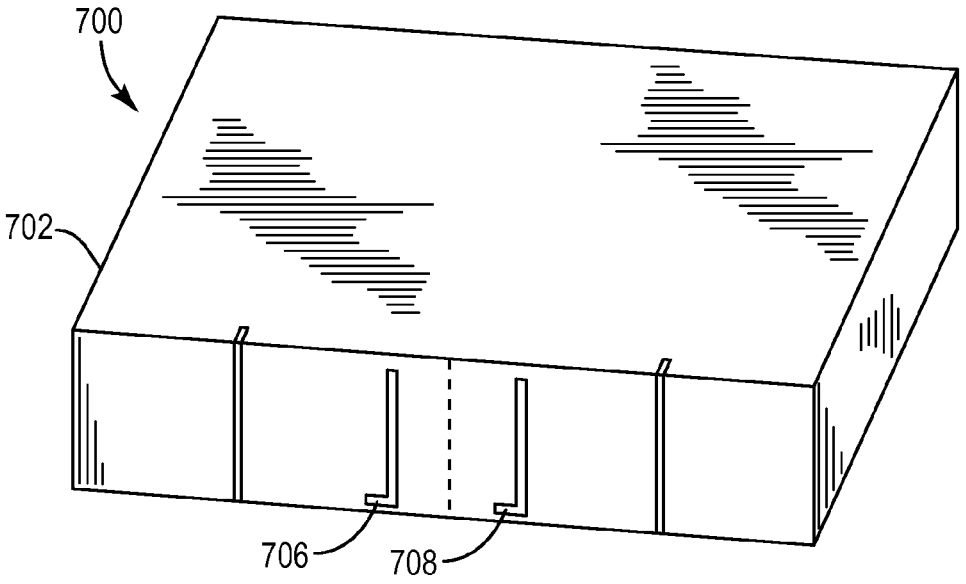
FIG. 7 illustrates a metal housing of an electronic device according to another embodiment.

FIG. 7 illustrates a metal housing 702 of an electronic device 700 according to another embodiment. The metal housing 702 includes a first slot 706 and a second slot 708. A fin structure (not illustrated in FIG. 7) disposed within the metal housing 702 has a first sectorial cavity formed behind a first portion of the wall of the metal housing 702 corresponding to the first slot 706 and a second sectorial cavity formed behind a second portion of the wall of the metal housing 702 corresponding to the second slot 708. A dashed line is illustrated in FIG. 7 to identify a fin that separates the first sectorial cavity and the second sectorial cavity.

The depicted embodiments illustrate cylindrical and cuboid shapes. In other embodiments, the metal housing and fin structures maybe any polyhedrons.

In one embodiment, an electronic device includes a metal housing with a first slot formed in a first portion of a wall of the metal housing and a second slot formed in a second portion of the wall. The electronic device also includes a fin structure disposed within the metal housing. The fin structure includes multiple fins that form a first sectorial cavity behind the first portion of the wall corresponding to the first slot and a second sectorial cavity behind the second portion of the wall corresponding to the second slot. The electronic device also includes RF circuitry disposed on a circuit board disposed within the metal housing. The RF circuitry is operable to radiate electromagnetic energy via the first slot and to radiate electromagnetic energy via the second slot.

In a further embodiment, the first slot is disposed on a first centerline of the first portion corresponding to the first sectorial cavity and the second slot is disposed on a second centerline of the second portion corresponding to the second sectorial cavity.

As illustrated and described above, the metal housing is a cylindrical metal housing, and the fins are a set of radial fins disposed within the cylindrical metal housing. In another embodiment, the metal housing is a cuboid and the fin structure fits within the cuboid to form the sectorial cavities. In one embodiment, the first sectorial cavity is formed by a first surface of a first radial fin, a first surface of a second radial fin and an inner surface of the first portion of the wall. In one embodiment, as illustrated in FIG. 1B, the set of radial fins includes a first subset of radial fins disposed on a first side of the circuit board and a second subset of radial fins disposed on a second side of the circuit board. The circuit board may be disposed perpendicular to the first slot and the second slot at a middle of the first slot and a middle of the second slot. Alternatively, the circuit board may be disposed at other locations relative to the slots, such as at the bottom or top of the slots. It should be noted that the circuit board may be disposed with a buffer between the top edge or the bottom edge so as to not short the slot. For example, the circuit board may be disposed 3 mm or more away from top or bottom edge of the respective slot.

In another embodiment, the metal housing is a first polyhedron with an internal cavity. The fin structure is a second polyhedron that fits within the first polyhedron. The fins are interposed between an outer surface of the second polyhedron and an inner surface of the first polyhedron. In one embodiment, the first polyhedron is a first cuboid and the second polyhedron is a second cuboid. The fins in some of these embodiments may include a first set of fins disposed in a first orientation and a second set of fins disposed in a second orientation that is orthogonal to the first orientation.

As described herein, the fin structure may be metal or plastic. When the fin structure is plastic, the plastic can be coated in metal in designated locations or on all surfaces that form the sectorial cavities.

In one embodiment, the electronic device is a set-top box (STB). The STB includes a metal housing with a first slot formed in a first portion of a wall of the metal housing and oriented on a first axis and a second slot formed in a second portion of the wall of the metal housing and oriented on a second axis. The metal housing may be a first polyhedron. A fin structure is disposed within the metal housing. The fin structure may be a second polyhedron that fits within the first polyhedron. The fin structure includes multiple fins that form a first sectorial cavity behind the first portion of the wall corresponding to the first slot and a second sectorial cavity behind the second portion of the wall corresponding to the second slot. A PCB can be disposed within the metal housing. A first RF circuit and a second RF circuit can be disposed on the PCB. The first RF circuit is operable to radiate electromagnetic energy via the first slot in a first frequency range and the second RF circuit is operable to radiate electromagnetic energy via the second slot in the first frequency range concurrently with the first RF circuit. In some embodiments, the RF circuits can be configured to operate the first slot and the second slot in a beam-forming manner. Alternatively, the RF circuits can operate the first slot and the second slot concurrently with sufficient isolations because of the sectorial cavities behind the first slot and second slot, respectively. As described herein, the PCB may include a first conductive trace coupled between the first RF circuit and a first feeding point on an inner surface of the metal housing near the first slot and a second conductive trace coupled between the second RF circuit and a second feeding point on the inner surface near the second slot.

In one embodiment, the first RF circuit is a WLAN module and the second RF circuit is a PAN modules. The WLAN module can operate the first slot antenna using the Wi-Fi® technology in the 2.45 GHz frequency band and the PAN module can operate the second slot antenna using the Bluetooth® technology in the 2.45 GHz frequency band with sufficient isolation between the first slot and the second slot. In another embodiment, the first RF circuit is a first WLAN module and the second RF circuit is a second WLAN module. In some embodiments, the first RF circuit and the second RF circuit reside on a common carrier substrate die of an integrated circuit. In other embodiments, a processor is disposed on the PCB along with the first RF circuit and the second RF circuit. The processor is operable to control the first RF circuit and the second RF circuit to radiate electromagnetic energy concurrently in the first frequency range via the first slot and the second slot. Alternatively, the processor can be disposed on another circuit board than the first RF circuit and the second RF circuit. Alternatively, the first RF circuit and the second RF circuit can be implemented as RF circuitry in a single integrated circuit. In one embodiment, the RF circuitry includes a WLAN module. The WLAN module is operable to cause a first slot to radiate electromagnetic energy in a first frequency range and a second slot to radiate electromagnetic energy in the first frequency range as well. In another embodiment, the RF circuitry may include other modules, such as a wireless area network (WAN) module, a personal area network (PAN) module, global navigation satellite system (GNSS) module (e.g., global positioning system (GPS) module), or the like. The slots can be designed to operate in the dual-band WLAN networks, for example, using the Wi-Fi® technology in the 2.45 GHz band and the 5 GHz band. For example, the WLAN module may include a WLAN RF transceiver for communications on one or more frequency bands (e.g., 2.45 GHz and 5 GHz). It should be noted that the Wi-Fi® technology is the industry name for wireless local area network communication technology related to the IEEE 802.11 family of wireless networking standards by Wi-Fi Alliance. For example, a dual-band WLAN RF transceiver allows an electronic device to exchange data or connection to the Internet wireless using radio waves in two WLAN bands (2.45 GHz band, 5 GHz band) via one or multiple antennas. For example, a dual-band WLAN RF transceiver includes a 5 GHz WLAN channel and a 2.45 GHz WLAN channel. In other embodiments, the antenna architecture may include additional RF modules and/or other communication modules, such as a wireless local area network (WLAN) module, a GPS receiver, a near field communication (NFC) module, an amplitude modulation (AM) radio receiver, a frequency modulation (FM) radio receiver, a personal area network (PAN) module (e.g., Bluetooth® module, Zigbee® module), a Global Navigation Satellite System (GNSS) receiver, or the like. The RF circuitry may include one or multiple RFFE (also referred to as RF circuitry). The RFFEs may include receivers and/or transceivers, filters, amplifiers, mixers, switches, and/or other electrical components. The RF circuitry may be coupled to a modem that allows the user device to handle both voice and non-voice communications (such as communications for text messages, multimedia messages, media downloads, web browsing, etc.) with a wireless communication system. The modem may provide network connectivity using any type of digital mobile network technology including, for example, LTE, LTE advanced (4G), CDPD, GPRS, EDGE, UMTS, 1×RTT, EVDO, HSDPA, WLAN (e.g., Wi-Fi® network), etc. In the depicted embodiment, the modem can use the RF circuitry to radiate electromagnetic energy on the antennas to communication data to and from the user device in the respective frequency ranges. In other embodiments, the modem may communicate according to different communication types (e.g., WCDMA, GSM, LTE, CDMA, WiMAX, etc.) in different cellular networks. It should be noted that radiation enables functionality of both transmission and receiving data using reciprocity.

In further embodiments, the metal housing may further includes a third slot formed in the first portion of the wall of the metal housing and oriented on a third axis and a fourth slot formed in the second portion of the wall of the metal housing and oriented on a fourth axis. The first sectorial cavity is located behind the first portion of the wall corresponding to the first slot and the third slot and the second sectorial cavity is located behind the second portion of the wall corresponding to the second slot and the fourth slot. The first slot has a first length, the second slot has the first length, the third slot has a second length and the fourth slot has the second length. The second length is less than the first length.

The user device (also referred to herein as an electronic device) may be any content rendering device that includes a modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, Blu-ray® or DVD players, media centers, drones, audio-input-enabled devices, speech-based personal data assistants, and the like. The user device may connect to a network to obtain content from a server computing system (e.g., an item providing system) or to perform other activities. The user device may connect to one or more different types of cellular networks.

Figure 8:
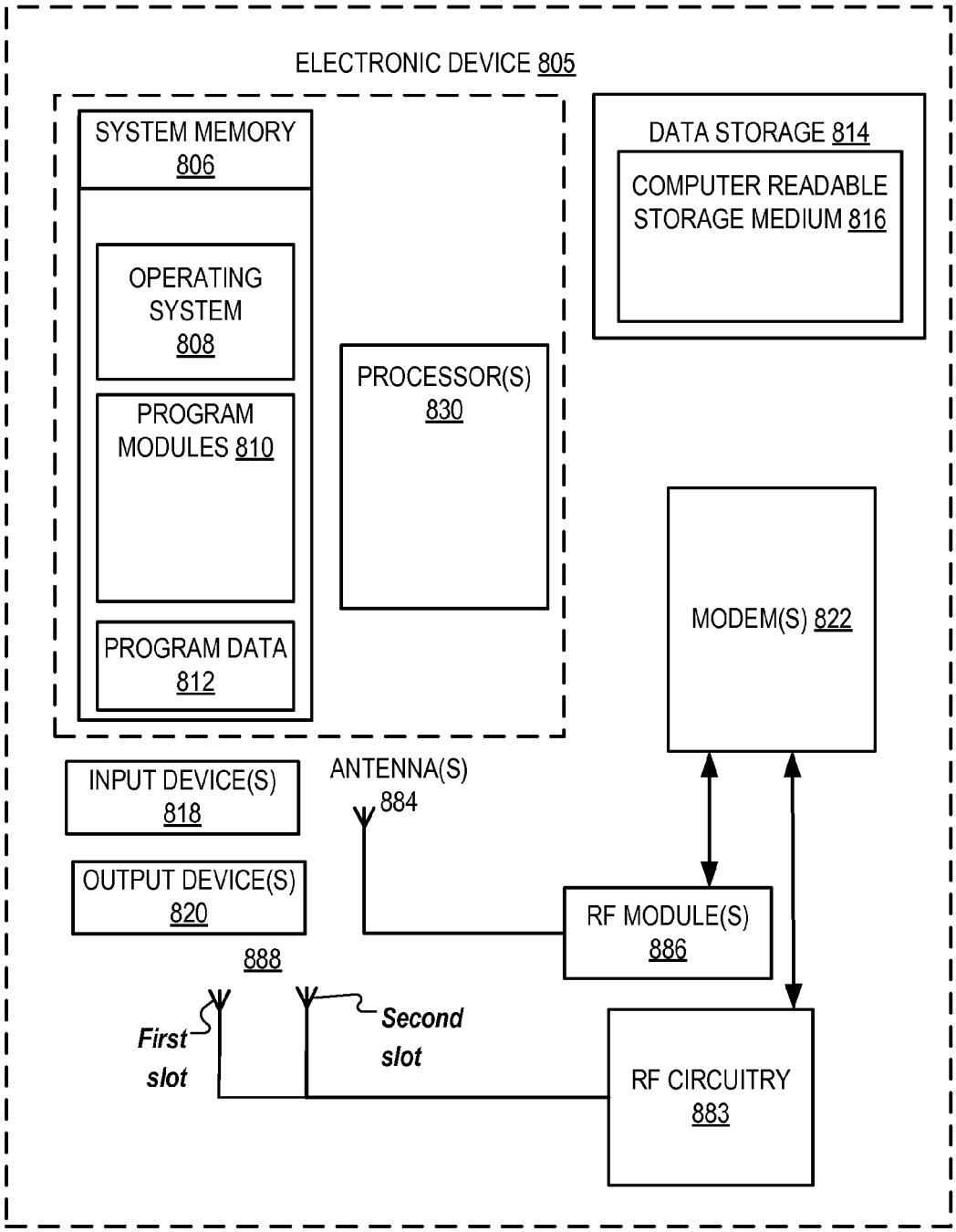
FIG. 8 is a block diagram of a user device in which embodiments of slot antennas in a metal housing and a fin structure to form sectorial cavities may be implemented.

FIG. 8 is a block diagram of an electronic device 805 in which embodiments of slot antennas in a metal housing and a fin structure to form sectorial cavities may be implemented. The electronic device 805 may correspond to the device 100 of FIG. 1A, device 200 of FIG. 2, device 300 of FIG. 3A, device 400 of FIG. 4A, electronic device 500 of FIG. 5A, electronic device 600 of FIG. 6, and electronic device 700 of FIG. 7. The electronic device 805 may be any type of computing device such as an electronic book reader, a PDA, a mobile phone, a laptop computer, a portable media player, a tablet computer, a camera, a video camera, a netbook, a desktop computer, a gaming console, a DVD player, a Bluray®, a computing pad, a media center, an audio-input-enabled device, a speech-based personal data assistant, and the like. The electronic device 805 may be any portable or stationary user device. For example, the electronic device 805 may be an intelligent voice control and speaker system. Alternatively, the electronic device 805 can be any other device used in a WLAN network (e.g., Wi-Fi® network), a WAN network, or the like.

The electronic device 805 includes one or more processor(s) 830, such as one or more CPUs, microcontrollers, field programmable gate arrays, or other types of processors. The electronic device 805 also includes system memory 806, which may correspond to any combination of volatile and/or non-volatile storage mechanisms. The system memory 806 stores information that provides operating system component 808, various program modules 810, program data 812, and/or other components. In one embodiment, the system memory 806 stores instructions of the methods as described herein. The electronic device 805 performs functions by using the processor(s) 830 to execute instructions provided by the system memory 806.

The electronic device 805 also includes a data storage device 814 that may be composed of one or more types of removable storage and/or one or more types of non-removable storage. The data storage device 814 includes a computer-readable storage medium 816 on which is stored one or more sets of instructions embodying any of the methodologies or functions described herein. Instructions for the program modules 810 may reside, completely or at least partially, within the computer-readable storage medium 816, system memory 806 and/or within the processor(s) 830 during execution thereof by the electronic device 805, the system memory 806 and the processor(s) 830 also constituting computer-readable media. The electronic device 805 may also include one or more input devices 818 (keyboard, mouse device, specialized selection keys, etc.) and one or more output devices 820 (displays, printers, audio output mechanisms, etc.).

The electronic device 805 further includes a modem 822 to allow the electronic device 805 to communicate via a wireless network (e.g., such as provided by the wireless communication system) with other computing devices, such as remote computers, an item providing system, and so forth. The modem 822 can be connected to RF circuitry 883 and zero or more RF modules 886. The RF circuitry 883 may be a WLAN module, a WAN module, PAN module, or the like. Slot antennas 888 are coupled to the RF circuitry 883, which is coupled to the modem 822. The slot antennas 888 include a first slot antenna and a second slot antenna as described herein. Zero or more antennas 884 can be coupled to one or more RF modules 886, which are also connected to the modem 822. The zero or more antennas 884 may be GPS antennas, NFC antennas, other WAN antennas, WLAN or PAN antennas, or the like. The modem 822 allows the electronic device 805 to handle both voice and non-voice communications (such as communications for text messages, multimedia messages, media downloads, web browsing, etc.) with a wireless communication system. The modem 822 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 822 may generate signals and send these signals to antennas 888, and 884 via RF circuitry 883, and RF module(s) 886 as descried herein. Electronic device 805 may additionally include a WLAN module, a GPS receiver, a PAN transceiver and/or other RF modules. These RF modules may additionally or alternatively be connected to one or more of antennas 884, 888. Antennas 884, 888 may be configured to transmit in different frequency bands and/or using different wireless communication protocols. The antennas 884, 888 may be directional, omnidirectional, or non-directional antennas. In addition to sending data, antennas 884, 888 may also receive data, which is sent to appropriate RF modules connected to the antennas.

In one embodiment, the electronic device 805 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 822 is shown to control transmission and reception via antenna (884, 888), the electronic device 805 may alternatively include multiple modems, each of which is configured to transmit/receive data via a different antenna and/or wireless transmission protocol.

The electronic device 805 delivers and/or receives items, upgrades, and/or other information via the network. For example, the electronic device 805 may download or receive items from an item providing system. The item providing system receives various requests, instructions and other data from the electronic device 805 via the network. The item providing system may include one or more machines (e.g., one or more server computer systems, routers, gateways, etc.) that have processing and storage capabilities to provide the above functionality. Communication between the item providing system and the electronic device 805 may be enabled via any communication infrastructure. One example of such an infrastructure includes a combination of a wide area network (WAN) and wireless infrastructure, which allows a user to use the electronic device 805 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by products using the Wi-Fi® technology based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the electronic device 805.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The electronic devices 805 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The electronic devices 805 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 9:
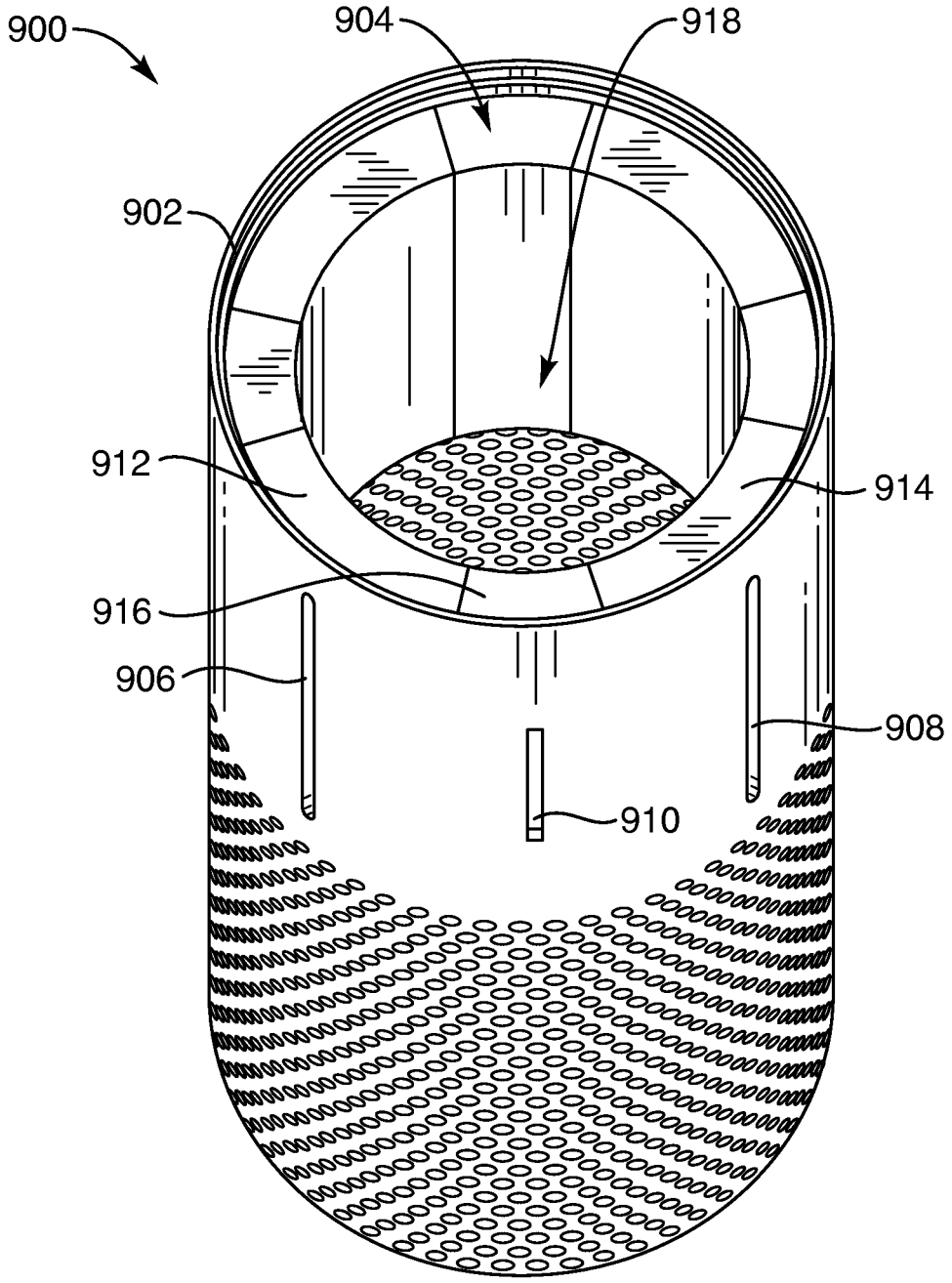
FIG. 9 illustrates a device with a cylindrical metal housing and a set of radial fins with a ring shape according to one embodiment.

FIG. 9 illustrates a device with a cylindrical metal housing 902 and a set of radial fins 904 with a ring shape according to one embodiment. The set of radial fins 904 fits within the cylindrical metal housing 902 of the device 900 according to one embodiment. The set of radial fins 904 are different from the set of radial fins 104 of FIG. 1B in that the fins 904 have a ring shape with an inner cavity 918 to accommodate other components within the device housing, such as audio components, RF components, or the like. The device 900 may be similar to the device 100 as described above in other regards. A first slot 906 is formed in the wall of the cylindrical metal housing 902 and oriented along a length of the cylindrical metal housing 902 in a first axis. A second slot 908 is formed in the wall of the cylindrical metal housing 902 and oriented along the length of the cylindrical metal housing 902 in a second axis. A PCB (not illustrated) is disposed within cylindrical metal housing 902, and may include a processor, RF circuitry, or any combination thereof disposed on the PCB. The PCB may include conductive traces coupled to feeding point on an inner surface of the cylindrical metal housing 902 near the first slot 906 and the second slot 908.

The set of radial fins 904 is disposed within the cylindrical metal housing 902. The set of radial fins 104 and the inner surface of the cylindrical metal housing 902 form sectorial cavities. A first sectorial cavity 912 is located behind a first portion of the wall corresponding to the first slot 906 and a second sectorial cavity 914 is located behind a second portion of the wall corresponding to the second slot 908. More specifically, two adjacent radial fins and the inner surface of the first portion of the wall form the first sectorial cavity 912 and another two adjacent radial fins and the inner surface of the second portion of the wall form the second sectorial cavity 914. A third sectorial cavity 916 is located behind a third portion of the wall corresponding to a third slot 910. The first sectorial cavity 912 may be formed with stamped metal, on the other five sides. The five sides of metal, along with the inner surface of the first portion forms, the first sectorial cavity 912. The second sectorial cavity 914 and third sectorial cavity 916 may be formed in a similar manner. In another embodiment, the cavities may be implemented using foam, such as low density foam, and a metal mesh (e.g., copper mesh). For example, the fives sides of the foam can be coated with the copper mesh. The sectorial cavities being formed with the foam and copper mesh can create an inner space or inner cavity in which other components of the device can be disposed.

In the depicted embodiment, the three slots are illustrated, but additional slots can be formed in portions of the wall corresponding to the other sectorial cavities formed by the foam and copper mesh. In the depicted embodiment, the first slot 906 and the second slot 908 may have the same length and the third slot 910 can be a shorter length. In one embodiment, the first length corresponds to a first frequency range, such as 2.45 GHz, and the second length corresponds to a second frequency range, such as 5 GHz. In another embodiment, the third slot may be formed in one of the sectorial cavities with either the first slot 906 or second slot 908.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A device comprising:

a cylindrical metal housing comprising:

a first slot formed in a wall of the cylindrical metal housing and oriented along a length of the cylindrical metal housing in a first axis; and a second slot formed in the wall and oriented along the length of the cylindrical metal housing in a second axis parallel to the first axis;

a printed circuit board (PCB) disposed within cylindrical metal housing;

a processor disposed on the PCB;

RF circuitry disposed on the PCB, wherein the PCB comprises:

a first conductive trace coupled between the RF circuitry and a first feeding point on an inner surface of the cylindrical metal housing near the first slot; and a second conductive trace coupled between the RF circuitry and a second feeding point on the inner surface near the second slot; and a set of radial fins disposed within the cylindrical metal housing, wherein the set of radial fins and the inner surface of the cylindrical metal housing form sectorial cavities, wherein a first sectorial cavity is located behind a first portion of the wall corresponding to the first slot, and wherein a second sectorial cavity is located behind a second portion of the wall corresponding to the second slot.

2. The device of claim 1, wherein the first slot is disposed on a first centerline of the first portion, and wherein the second slot is disposed on a second centerline of the second portion.

3. The device of claim 1, wherein the cylindrical metal housing further comprises:

a third slot formed in the first portion of the wall of the cylindrical metal housing and oriented along the length of the cylindrical metal housing in a third axis that is parallel to the first axis, wherein the first sectorial cavity is located behind the first portion of the wall corresponding to the first slot and the third slot; and a fourth slot formed in the second portion of the wall of the cylindrical metal housing and oriented along the length of the cylindrical metal housing in a fourth axis that is parallel to the second axis, wherein the second sectorial cavity is located behind the second portion of the wall corresponding to the second slot and the fourth slot, wherein the first slot has a first length, the second slot has the first length, the third slot has a second length and the fourth slot has the second length, and wherein the second length is less than the first length.

4. The device of claim 1, wherein the set of radial fins comprises:

a first subset of radial fins disposed on a first side of the PCB; and a second subset of radial fins disposed on a second side of the PCB, wherein the PCB is disposed perpendicular to the first slot and the second slot and is disposed at a middle of the first slot and a middle of the second slot.

5. An electronic device comprising:

a metal housing comprising:

a first slot formed in a first portion of a wall of the metal housing; and a second slot formed in a second portion of the wall;

a fin structure disposed within the metal housing, wherein the fin structure comprises:

a first fin and a second fin that form a first sectorial cavity behind the first portion of the wall corresponding to the first slot; and a third fin and a fourth fin that forms a second sectorial cavity behind the second portion of the wall corresponding to the second slot;

RF circuitry disposed within the metal housing, wherein the RF circuitry is operable to radiate electromagnetic energy via the first slot and the second slot;

a first conductive trace coupled between the RF circuitry and a first feeding point on an inner surface of the metal housing near the first slot in the first portion; and a second conductive trace coupled between the RF circuitry and a second feeding point on the inner surface near the second slot in the second portion.

6. The electronic device of claim 5, wherein the first slot is disposed on a first centerline of the first portion, and wherein the second slot is disposed on a second centerline of the second portion.

7. The electronic device of claim 5, wherein the metal housing is a cylindrical metal housing, wherein the first fin, the second fin, third fin, and fourth fin are part of a set of radial fins, wherein the first sectorial cavity is formed by a first surface of a first radial fin of the set of radial fins, a first surface of a second radial fin of the set of radial fins and an inner surface of the first portion of the wall.

8. The electronic device of claim 7, wherein the set of radial fins comprises:

a first subset of radial fins disposed on a first side of a circuit board comprising the RF circuitry; and a second subset of radial fins disposed on a second side of the circuit board, wherein the circuit board is disposed perpendicular to the first slot and the second slot at a middle of the first slot and a middle of the second slot.

9. An electronic device comprising:

a metal housing comprising:

a first slot formed in a first portion of a wall of the metal housing; and a second slot formed in a second portion of the wall;

a fin structure disposed within the metal housing, wherein the fin structure comprises:

a first fin and a second fin that form a first sectorial cavity behind the first portion of the wall corresponding to the first slot; and a third fin and a fourth fin that forms a second sectorial cavity behind the second portion of the wall corresponding to the second slot; and RF circuitry disposed within the metal housing, wherein the RF circuitry is operable to radiate electromagnetic energy via the first slot and the second slot, wherein the metal housing is a first polyhedron with an internal cavity, wherein the fin structure comprises:

a second polyhedron that fits within the first polyhedron; and the first fin, the second fin, the third fin, and the fourth fin interposed between an outer surface of the second polyhedron and an inner surface of the first polyhedron.

10. The electronic device of claim 9, wherein the first polyhedron is a first cuboid, wherein the second polyhedron is a second cuboid, wherein the fin structure comprises:

a first set of fins disposed in a first orientation; and a second set of fins disposed in a second orientation that is orthogonal to the first orientation.

11. The electronic device of claim 5, wherein the fin structure comprises at least one of plastic with a metal coating or metal.

12. An electronic device comprising:

a metal housing comprising:

a first slot formed in a first portion of a wall of the metal housing; and a second slot formed in a second portion of the wall;

a fin structure disposed within the metal housing, wherein the fin structure comprises:

a first fin and a second fin that form a first sectorial cavity behind the first portion of the wall corresponding to the first slot; and a third fin and a fourth fin that forms a second sectorial cavity behind the second portion of the wall corresponding to the second slot; and RF circuitry disposed within the metal housing, wherein the RF circuitry is operable to radiate electromagnetic energy via the first slot and the second slot, wherein the metal housing is a cylindrical metal housing, wherein the first slot is oriented along a length of the cylindrical metal housing in a first axis, wherein the second slot is oriented along the length of the cylindrical metal housing in a second axis parallel to the first axis, wherein the cylindrical metal housing further comprises a third slot formed in the wall and oriented along a circumference of the cylindrical metal housing in a first plane perpendicular to the first axis.

13. The electronic device of claim 12, wherein the cylindrical metal housing further comprises a fourth slot formed in the wall and oriented along the circumference of the cylindrical metal housing in a second plane perpendicular to the first axis.

14. A set-top box (STB) comprising:

a metal housing comprising:

a first slot formed in a first portion of a wall of the metal housing and oriented on a first axis; and a second slot formed in a second portion of the wall of the metal housing and oriented on a second axis, wherein the metal housing is a first polyhedron;

a fin structure disposed within the metal housing, wherein the fin structure is a second polyhedron that fits within the first polyhedron, and wherein the fin structure comprises a plurality of fins that form a first sectorial cavity behind the first portion of the wall corresponding to the first slot and a second sectorial cavity behind the second portion of the wall corresponding to the second slot;

a printed circuit board (PCB) disposed within the metal housing;

a first radio frequency (RF) circuit disposed on the PCB, wherein the first RF circuit is operable to radiate electromagnetic energy via the first slot in a first frequency range; and a second RF circuit disposed on the PCB, wherein the second RF circuit is operable to radiate electromagnetic energy via the second slot in the first frequency range concurrently with the first RF circuit.

15. The STB of claim 14, wherein the first RF circuit is a wireless local area network (WLAN) module, and wherein the second RF circuit is a personal area network (PAN) module.

16. The STB of claim 14, wherein the first RF circuit is a first wireless local area network (WLAN) module, and wherein the second RF circuit is a second WLAN module.

17. The STB of claim 16, wherein the first WLAN module and the second WLAN module reside on a common carrier substrate die of an integrated circuit.

18. The STB of claim 14, wherein the metal housing further comprises:

a third slot formed in the first portion of the wall of the metal housing and oriented on a third axis that is parallel to the first axis, wherein the first sectorial cavity is located behind the first portion of the wall corresponding to the first slot and the third slot; and a fourth slot formed in the second portion of the wall of the metal housing and oriented on a fourth axis that is parallel to the second axis, wherein the second sectorial cavity is located behind the second portion of the wall corresponding to the second slot and the fourth slot, wherein the first slot has a first length, the second slot has the first length, the third slot has a second length and the fourth slot has the second length, and wherein the second length that is less than the first length.

19. The STB of claim 14, wherein the PCB further comprises:

a first conductive trace coupled between the first RF circuit and a first feeding point on an inner surface of the metal housing near the first slot; and a second conductive trace coupled between the second RF circuit and a second feeding point on the inner surface near the second slot.

20. The STB of claim 14, further comprising a processor disposed on the PCB and coupled to the first RF circuit and the second RF circuit, wherein the processor is operable to control the first RF circuit and the second RF circuit to radiate electromagnetic energy concurrently in the first frequency range via the first slot and the second slot.

* * * * *